US007668478B2

(12) United States Patent
Al

(10) Patent No.: US 7,668,478 B2
(45) Date of Patent: Feb. 23, 2010

(54) IMAGE FORMING APPARATUS INCLUDING TWO TONER CLEANING MEMBERS

(75) Inventor: Ryuta Al, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 139 days.

(21) Appl. No.: 11/693,113

(22) Filed: Mar. 29, 2007

(65) Prior Publication Data

US 2007/0242972 A1 Oct. 18, 2007

(30) Foreign Application Priority Data

Apr. 13, 2006 (JP) ..... 2006-111045

(51) Int. Cl.
*G03G 15/16* (2006.01)

(52) U.S. Cl. ..... 399/101

(58) Field of Classification Search ..... 399/101
See application file for complete search history.

(56) References Cited

U.S. PATENT DOCUMENTS

| | | | | |
|---|---|---|---|---|
| 4,379,630 | A * | 4/1983 | Suzuki | 399/313 |
| 5,233,398 | A * | 8/1993 | Nimura et al. | 399/354 |
| 5,546,177 | A | 8/1996 | Thayer | |
| 5,587,781 | A * | 12/1996 | Auty et al. | 399/353 |
| 6,175,711 | B1 | 1/2001 | Yoshino et al. | 399/297 |
| 7,127,191 | B2 | 10/2006 | Mori et al. | 399/101 |
| 7,251,433 | B2 | 7/2007 | Ai et al. | |
| 2004/0213598 | A1 * | 10/2004 | Mori et al. | 399/101 |
| 2005/0191069 | A1 | 9/2005 | Yamaki et al. | |
| 2005/0220478 | A1 * | 10/2005 | Ai et al. | 399/101 |
| 2006/0210300 | A1 * | 9/2006 | Nishikawa | 399/101 |

FOREIGN PATENT DOCUMENTS

| | | | |
|---|---|---|---|
| EP | 0 512 362 | A2 | 11/1992 |
| JP | 8-146781 | A | 6/1996 |
| JP | 10-3222 | A | 1/1998 |
| JP | 2000-187405 | A | 7/2000 |
| JP | 2002-229344 | A | 8/2002 |
| JP | 2003-66735 | A | 3/2003 |

(Continued)

OTHER PUBLICATIONS

Chinese Office Action dated Aug. 22, 2008 in Chinese Application No. 200710096120.6, and English-language translation thereof.

*Primary Examiner*—David M Gray
*Assistant Examiner*—Billy J Lactaoen
(74) *Attorney, Agent, or Firm*—Fitzpatrick, Cella, Harper & Scinto

(57) ABSTRACT

An image forming apparatus has: an image bearing member which bears a toner image; a transfer member which comes into pressure contact with the image bearing member and transfers the toner image on the image bearing member onto a recording material; a first cleaning member which electrostatically collects the toner on the transfer member; and a second cleaning member which electrostatically collects the toner on the first cleaning member, wherein when a ratio of an amount of toner which is adsorbed by the first cleaning member to an amount of toner on the transfer member is assumed to be $\alpha$(%) and a ratio of an amount of toner which is adsorbed by the second cleaning member to an amount of toner on the first cleaning member is assumed to be $\beta$(%), $\alpha>90$(%), $\beta>90$(%), and $\alpha \leqq \beta$.

8 Claims, 8 Drawing Sheets

FOREIGN PATENT DOCUMENTS

| | | | |
|---|---|---|---|
| JP | 2004-245941 | A | 9/2004 |
| JP | 2004-310060 | A | 11/2004 |
| JP | 2004-348060 | A | 12/2004 |
| JP | 2005-221537 | A | 8/2005 |
| JP | 2005-250039 | A | 9/2005 |
| JP | 2005-315987 | A | 11/2005 |

* cited by examiner

IMAGE FORMING APPARATUS INCLUDING TWO TONER CLEANING MEMBERS

BACKGROUND OF THE INVENTION

1. Field of the Invention

The present invention relates to an image forming apparatus such as copying apparatus, or printer in which a toner image formed on an image-bearing member is transferred onto a recording material by a transfer unit and an image is formed.

2. Description of the Related Art

In recent years, in an image forming apparatus for forming a toner image by an electrophotographic image forming process, improvement of image quality is required. As one of such requirements, there is a prevention of toner deposition onto a back surface of a recording material (transfer material).

For this purpose, a member for cleaning a transfer member for transferring the toner image formed on a photosensitive drum or an intermediate transfer belt onto the recording material has been provided. A method whereby a blade-shaped cleaning member comes into pressure contact with the transfer member has been used as a cleaning method. However, if the blade-shaped cleaning member comes into pressure contact with the transfer member, the transfer member is abraded.

As a method of cleaning the toner remaining on the intermediate transfer belt after the secondary transferring step, an electrostatic cleaning method of electrostatically removing the toner on the intermediate transfer belt has been proposed (refer to Japanese Patent Application Laid-Open No. 2002-229344). According to such a method, a conductive fur brush comes into contact with the intermediate transfer belt and rotated. A voltage-applied member such as a metal roller to which a voltage has been applied comes into contact with the conductive fur brush. Thus, the toner on the intermediate transfer belt is electrostatically adsorbed, thereby cleaning (electrostatic fur brush cleaning).

To reduce the abrasion of the transfer member, it has been tried to use the electrostatic fur brush cleaning in order to clean the transfer member.

However, when the cleaning of a transfer roller by the electrostatic fur brush cleaning is examined, it has been found that there are the following problems.

That is, if the cleaning is continuously executed, toner is accumulated to the fur brush, a function as a fur brush cannot be sufficiently effected, and there is a case where a back fouling of the transfer material is caused.

SUMMARY OF THE INVENTION

It is an object of the invention to provide an image forming apparatus in which a member for electrostatically cleaning a transfer member is provided, thereby enabling the transfer member to be stably cleaned.

Another object of the invention is to provide an image forming apparatus comprising: an image bearing member which bears a toner image; a transfer member which comes into pressure contact with the image bearing member and transfers the toner image on the image bearing member onto a recording material; a first cleaning member which electrostatically collects toner on the transfer member; and a second cleaning member which electrostatically collects the toner on the first cleaning member, wherein when a ratio of an amount of toner which is adsorbed by the first cleaning member to an amount of toner on the transfer member is assumed to be $\alpha$(%) and a ratio of an amount of toner which is adsorbed by the second cleaning member to an amount of toner on the first cleaning member is assumed to be $\beta$(%), $\alpha>90$(%), $\beta>90$(%), and $\alpha \leqq \beta$.

Further features of the present invention will become apparent from the following description of exemplary embodiments with reference to the attached drawings.

DESCRIPTION OF THE EMBODIMENTS

An image forming apparatus according to an embodiment of the invention will now be specifically described with reference to the drawings.

First Embodiment

Figure 1:
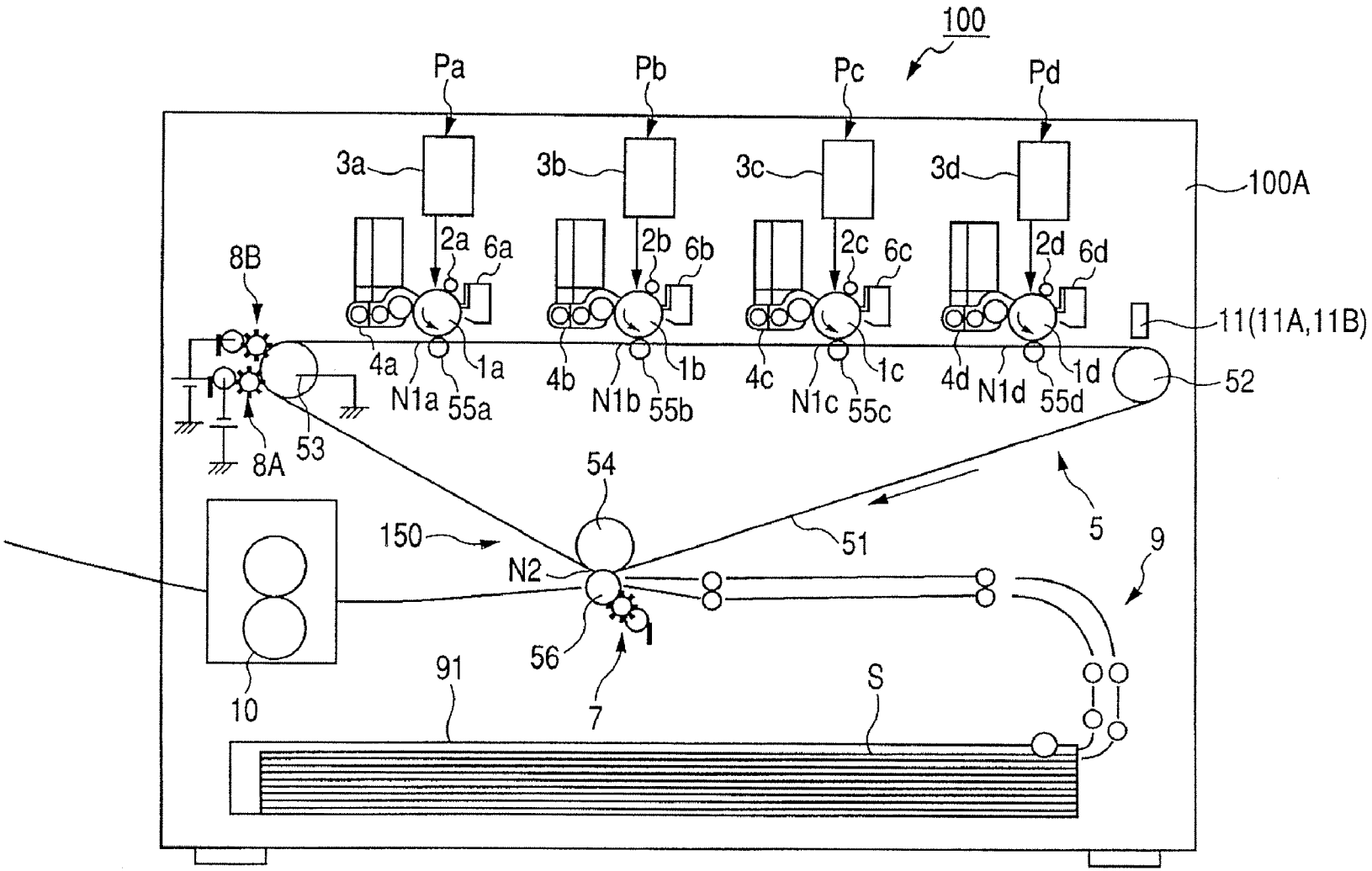
FIG. 1 is a schematic cross sectional view of an image forming apparatus according to the first embodiment.

FIG. 1 is a schematic cross-sectional explanatory diagram of the image forming apparatus according to the first embodiment.

[Whole Construction of Image Forming Apparatus]

First, a whole construction of the image forming apparatus will be described. An image forming apparatus 100 of the embodiment is a full color printer, which can form a full color image onto a transfer material (plain paper, OHP sheet, etc.) S by an electrophotographic system according to an image signal. The image signal is transmitted to an apparatus main body 100A from an external apparatus such as a personal computer, an image reading apparatus or a digital camera connected to the apparatus main body 100A so that it can communicate with the image forming apparatus 100.

The image forming apparatus 100 of the embodiment is a tandem type image forming apparatus. That is, the image forming apparatus 100 has an intermediate transfer belt 51 formed by an endless elastic belt as an intermediate transfer member. The intermediate transfer belt 51 is suspended as a supporting member to a driving roller 52, a tension roller 53, and a backup roller 54. Four image forming portions (first, second, third, and fourth image forming portions) Pa, Pb, Pc, and Pd, as image forming units for forming toner images, are serially arranged along a horizontal portion of the intermediate transfer belt 51.

In the embodiment, the image forming portions Pa, Pb, Pc, and Pd have substantially the same construction excluding the colors of the toner, which is used. Therefore, when it is unnecessary to particularly distinguish, suffixes a, b, c, and d added to reference numerals in order to indicate the elements provided for the respective colors are omitted and a description will be made in a lump.

The image-forming portion P has a drum-shaped electrophotographic photosensitive material (hereinafter, referred to as a "photosensitive drum") 1 as an image bearing member. The photosensitive drum 1 is rotated in the direction shown by an arrow (counterclockwise) in FIG. 1. The following processing apparatuses are arranged around the photosensitive drum 1: a charging roller 2 as a primary charging unit; an exposing apparatus as an exposing unit; a developing unit 4 as a developing device; a cleaning apparatus 6 as a cleaning unit; and the like.

The image forming portions Pa, Pb, Pc, and Pd form toner images of yellow, magenta, cyan, and black, respectively. That is, 2-component developers having toner of the respective colors of yellow (Y), magenta (M), cyan (C), and black (Bk) have been contained in the developing units 4*a* to 4*d* arranged in the image forming portions Pa, Pb, Pc, and Pd.

An intermediate transfer unit 5 having the intermediate transfer belt 51 is arranged so as to face the photosensitive drums 1*a* to 1*d* of the image forming portions Pa, Pb, Pc, and Pd. When a driving force is propagated to the driving roller 52, the intermediate transfer belt 51 is circulation-moved (rotated) in the direction shown by an arrow (clockwise) in FIG. 1. A primary transfer roller 55 constructing a primary transfer unit is arranged on the inner peripheral surface side of the intermediate transfer belt 51 at a position where it faces the photosensitive drum 1 of each image forming portion P. Since each primary transfer roller 55 presses the intermediate transfer belt 51 toward the photosensitive drum 1, primary transfer portions (primary transfer nips) N1*a* to N1*d*, where the intermediate transfer belt 51 comes into contact with the photosensitive drum 1, are formed.

A secondary transfer roller 56 as a secondary transfer member (transfer member) is arranged at a position where it faces the backup roller 54 through the intermediate transfer belt 51. The intermediate transfer belt 51 is sandwiched between the backup roller 54 and the secondary transfer roller 56, which construct a secondary transfer portion. Thus, a secondary transfer portion (secondary transfer nip) N2 in which the intermediate transfer belt 51 and the secondary transfer roller 56 come into contact with each other is formed.

When the full color image is formed, first, in the first image-forming portion Pa, the photosensitive drum 1*a* is uniformly charged by the charging roller 2*a*. Light according to the image signal of the yellow component color of an original document is projected from the exposing apparatus 3*a* onto the charged photosensitive drum 1*a* through a polygon mirror. Thus, an electrostatic latent image (latent image) according to the image signal of the yellow component color is formed onto the photosensitive drum 1*a*. Subsequently, the yellow toner is supplied from the developing unit 4*a*, so that the electrostatic latent image on the photosensitive drum 1*a* is developed as a yellow toner image. When the toner image reaches the primary transfer portion N1*a* in association with the rotation of the photosensitive drum 1*a*, it is transferred (primary transfer) onto the intermediate transfer belt 51 by the primary transfer roller 55*a*. In this instance, a predetermined primary transfer bias whose polarity is opposite to the normal charging polarity of the toner is applied to the primary transfer roller 55*a* from a primary transfer bias power source.

The intermediate transfer belt 51, which bears the yellow toner image, is conveyed to the next second image forming portion Pb. In the second image-forming portion Pb, a magenta toner image has been formed on the photosensitive drum 1*b* by a method similar to that mentioned above. In the primary transfer portion N1*b*, the magenta toner image is overlaid and transferred onto the yellow toner image on the intermediate transfer belt 51 by a method similar to that mentioned above.

Similarly, as the intermediate transfer belt 51 moves toward the third and fourth image forming portions Pc and Pd, in the primary transfer portions N1*c* and N1*d*, a cyan toner image and a black toner image are overlaid and transferred onto the toner images on the intermediate transfer belt 51.

The transfer material S is fed out from a cassette 91 in a transfer material supplying unit 9 and supplied to the secondary transfer portion N2 at timing matched with the toner images on the intermediate transfer belt 51.

In the secondary transfer portion N2, the toner images of the four colors on the intermediate transfer belt are transferred (secondary transfer) onto the transfer material (recording material) S by an electric field formed between the backup roller 54 and the secondary transfer roller 56. By applying a bias to either one of or both of the backup roller 54 and the secondary transfer roller 56, the electric field can be formed between those rollers. In the embodiment, in the secondary transfer step, a secondary transfer bias of the same polarity as that of the normal charging polarity of the toner is applied from a secondary transfer bias power source. In the case of applying the secondary transfer bias to the secondary transfer roller 56, it is sufficient to apply the bias of the polarity opposite to that of the normal charging polarity of the toner.

The transfer material S to which the toner images have been transferred is conveyed to a fixing unit 10. In the fixing unit 10, the toner images are fixed onto the transfer material S by heat and pressure.

The transfer residual toner on the photosensitive drum 1 which could not be completely transferred by the primary transfer step is cleaned by the cleaning apparatus 6 and supplied to the subsequent image forming step. The transfer residual toner on the intermediate transfer belt 51 which could not be completely transferred by the secondary transfer step is cleaned by a first belt cleaning apparatus 8A and a second belt cleaning apparatus 8B serving as belt cleaning units and supplied to the subsequent image forming step. In the embodiment, the first and second belt cleaning apparatuses 8A and 8B clean the intermediate transfer belt 51 by the electrostatic fur brush cleaning. Biases of opposite polarities are applied to the first and second belt cleaning apparatuses 8A and 8B.

The image forming apparatus 100 can also form an image of a desired color such as a black monochromatic image by using only a desired image-forming portion. In this case, only in the desired image-forming portion, the image forming step similar to that mentioned above is executed and only the toner image of the desired color is formed onto the intermediate transfer belt 51. This toner image is transferred onto the transfer material S and, thereafter, fixed.

[Image Concentration Control]

The image forming apparatus 100 of the embodiment forms control images (reference toner image for control, patch image) onto the intermediate transfer belt 51 and detects the control images by an image concentration sensor 11 as an image-detecting unit, thereby controlling image concentration.

The image concentration sensor 11 is arranged on the outer peripheral side of the intermediate transfer belt 51 at a position where the control images can be read out. In the embodiment, two image concentration sensors 11A and 11B are arranged in the width direction (direction which perpendicularly crosses the moving direction of the belt surface) of the intermediate transfer belt 51 at a position where they face the driving roller 52. Each of the image concentration sensors 11A and 11B is a light reflecting type sensor and has a light emitting portion and a photosensing portion. Light is irradiated onto the control images made by the toner formed on the intermediate transfer belt and its reflection light is measured. Detection signals of the image concentration sensors 11A and 11B are transmitted to a control unit.

The control unit makes image concentration control or the like based on the detection signals of the image concentration sensors 11A and 11B in order to obtain the proper image concentration. As image concentration control, one of the creation and correction controls of a γ correction table for deciding a rule adapted to convert the input image signal according to apparatus, characteristics and an environment can be mentioned. As image concentration control, one of control of image forming processing conditions (development contrast and laser power) and control of toner concentration of a developer in the developing unit 4 (toner supplement control) can be mentioned. In the embodiment, the control itself, which is made by using the control images, is arbitrarily made and can be used for control other than the above control.

In the image forming portions Pa to Pd, the control images are formed on the intermediate transfer belt 51 by an image forming process similar to the ordinary image creation through the forming, developing, and primary transfer steps of the electrostatic latent image (reference electrostatic latent image for control).

[Secondary Transfer Portion]

A construction of each member in the secondary transfer portion N2 and a cleaning construction of the secondary transfer roller will now be described.

Figure 2:
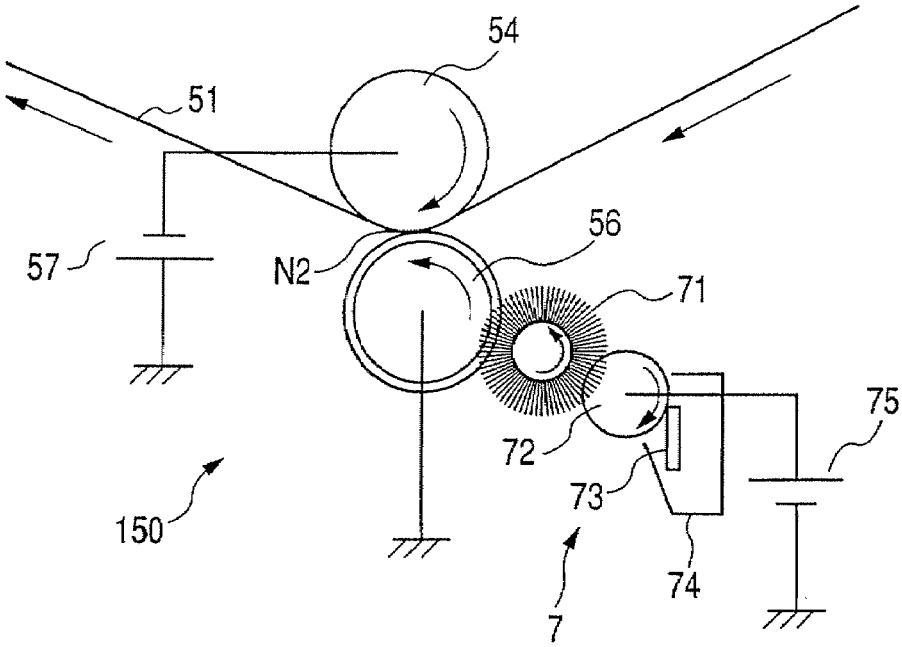
FIG. 2 is a schematic cross sectional view of a secondary transfer apparatus according to the first embodiment.

FIG. 2 is an enlarged explanatory diagram of the secondary transfer portion N2 and its peripheral portions. In the embodiment, in the secondary transfer portion N2, a secondary transfer apparatus 150 has: the backup roller 54 which comes into contact with the inner peripheral surface of the intermediate transfer belt 51 and rotates; and the secondary transfer roller 56 which comes into contact with the outer peripheral surface (toner image bearing surface) of the intermediate transfer belt 51 and rotates. The secondary transfer apparatus 150 is constructed by having a secondary transfer member cleaning apparatus 7 for cleaning the secondary transfer roller 56. The backup roller 54 and the secondary transfer roller 56 come into pressure contact with each other through the intermediate transfer belt 51.

In the embodiment, the secondary transfer roller 56, as a secondary transfer member, has a construction of two or more layers including an elastic rubber layer and a coating layer (surface layer). The elastic rubber layer is made by a foaming layer in which carbon black, whose cell diameter lies within a range from 0.05 to 1.0 mm, has been dispersed. The surface layer is made of a fluororesin system material having a thickness of 0.1 to 1.0 mm obtained by dispersing an ion conductive polymer. In the embodiment, the secondary transfer roller 56 is a rotor having an outer diameter of 24 mm. In the embodiment, the secondary transfer roller 56 is electrically connected to the ground.

When considering conveying performance of the secondary transfer roller 56 for the transfer material S, if a surface roughness of the secondary transfer roller 56 is equal to or less than 1.5 μm, the conveying performance deteriorates. Therefore, it is desirable to control a surface roughness Rz of a surface layer of the secondary transfer roller 56 so as to be (Rz>1.5 μm), more desirably, (Rz>6 μm).

When the toner deposited to the secondary transfer roller 56 is cleaned, if the surface roughness is equal to or larger than 15 μm, cleaning performance deteriorates. Therefore, it is desirable to control the surface roughness Rz of the secondary transfer roller 56 so as to be (Rz<15 μm), more desirably, (Rz<12 μm) in consideration of the cleaning performance or the like.

That is, the secondary transfer roller 56 is made of an elastic member having a coating layer on the surface and it is desirable to control the surface roughness Rz of the surface layer so as to lie within a range of (1.5 μm<Rz<15 μm), more desirably, (6 μm<Rz<12 μm). In this manner, since the roller, which has the coating layer on the surface and whose surface layer has uniformly been made coarse is used as a secondary transfer roller 56, the conveyance of the transfer material S can be stabilized.

It is desirable that an electric resistance value of the secondary transfer roller 56 lies within a range from $1.5\times10^5$ to $1.5\times10^6$ Ω/cm. If the resistance value is smaller than $1.5\times10^5$ Ω/cm, charges cannot be supplied to the toner and the transfer performance deteriorates. If the resistance value is larger than $1.5\times10^6$ Ω/cm, since a capacity of a high voltage power source is insufficient or the applied voltage is too high, such an abuse that a leakage is liable to occur is caused. In the embodiment, therefore, the resistance value of the secondary transfer roller 56 is set to $5\times10^5$ Ω/cm.

In the embodiment, the backup roller 54 is a rotor having an outer diameter of 24 mm. In the embodiment, the voltage of −3 kV having the same polarity as the normal charging polarity of the toner is applied as a secondary transfer bias to the backup roller 54.

In the secondary transfer apparatus 150, the secondary transfer roller 56 rotates at a peripheral velocity (surface moving speed), desirably, within a range from 200 to 500 mm/sec. In the embodiment, the secondary transfer roller 56 rotates at a speed of 300 mm/sec. The peripheral velocity of the secondary transfer roller 56 is substantially the same as the surface moving speed of the intermediate transfer belt 51. The backup roller 54 rotates at almost the same peripheral velocity as that of the secondary transfer roller 56.

The secondary transfer member cleaning apparatus 7 has: a fur brush 71 as a first cleaning member; a metal roller 72 as a bias applying member and a second cleaning member; a cleaning blade 73 as a scraping member; and a drain toner container 74. The fur brush 71 electrostatically adsorbs the toner on the secondary transfer roller 56 and collects it. The metal roller 72 is in contact with the fur brush 71 and applies a cleaning bias to the fur brush 71. The metal roller 72 electrostatically adsorbs the toner on the fur brush 71 and collects it. The cleaning blade 73 is arranged in contact with the metal roller 72, scrapes the toner on the metal roller 72, and collects it into the drain toner container 74.

The secondary transfer member cleaning apparatus 7 has: a cleaning bias power source 75 as a cleaning bias output unit. The cleaning bias power source 75 is connected to the metal roller 72. A bias generated from the cleaning bias power source 75 is applied to the fur brush 71 through the metal roller 72. It is generally desirable that the metal roller 72 is made of a member having excellent conductivity such as aluminum or SUS.

A description will be further made. In the embodiment, the metal roller 72 as a voltage-applying member with which the cleaning blade 73 has come into contact is in contact with the role-shaped fur brush 71 made by a conductive member. The cleaning bias is applied from the cleaning bias power source 75 to the metal roller 72. By applying the desired bias to the metal roller 72, a potential difference is caused between the fur brush 71 and the metal roller 72 by the resistance value of the fur brush 71. The toner, which has electrostatically been adsorbed from the secondary transfer roller 56 to the fur brush 71, is transferred to the metal roller 72 side by the potential difference. The toner transferred to the metal roller 72 is removed by the cleaning blade 73, which is in contact with the metal roller 72, thereby preventing the toner from generally remaining on the fur brush 71.

From a viewpoint of a space, it is desirable that an outer diameter of the fur brush 71 lies within a range from 10 to 30 mm in the state where the fur brush 71 is not penetrated into the secondary transfer roller 56 as a member to be cleaned. In the embodiment, the outer diameter of the fur brush 71 is set to 18 mm. That is, in the embodiment, a radius of the fur brush 71 is set to 9 mm in the state where it is not penetrated into the secondary transfer roller 56. In the embodiment, a length of fur of the fur brush 71 is set to 4 mm. A penetration amount of the fur to the secondary transfer roller 56 is set to 1.0 mm. Further, a penetration amount of the fur to the metal roller 72 is set to 1.5 mm. A density of the fur of the fur brush 71 is set to 120 kF/inch$^2$.

In the above construction, in the case of cleaning the toner of the control images deposited to the secondary transfer roller 56, the cleaning process is executed by the following two steps. The first process is a process for transferring the toner from the secondary transfer roller 56 to the fur brush 71 (hereinafter, referred to as a "cleaning process 1"). The second process is a process for transferring the toner from the fur brush 71 to the metal roller 72 (hereinafter, referred to as a "cleaning process 2"). In the case of desirably cleaning the control images having a large concentration, it is necessary to transfer a larger amount of toner in each of the cleaning process 1 and the cleaning process 2.

Figure 3:
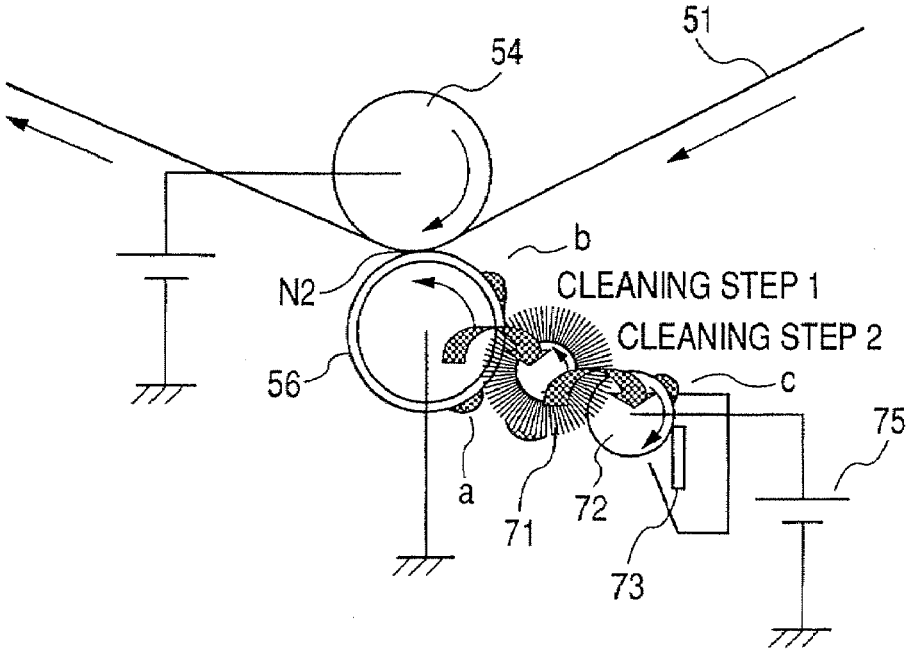
FIG. 3 is an explanatory diagram of a toner cleaning efficiency of a secondary transfer roller.

To quantify cleaning characteristics of the control images of the cleaning processes 1 and 2, a cleaning efficiency in each process is measured. FIG. 3 illustrates a schematic diagram. The measurement of the cleaning efficiency in the cleaning process 1 is made in the state where the image forming apparatus has been stopped before and after a control image (a) passes/passed through the cleaning process 1. To accurately measure the cleaning efficiency, it is the most accurate method to adsorb, collect, and measure control images (a) and (b). However, in the embodiment, the control images are transported onto a transparent seal and their concentration is measured, thereby substituting concentration values for toner weights of the control images (a) and (b). Generally, since there is a linear correlation between the toner weight and the toner concentration measured by a densitometer, even if the toner weight is replaced by the concentration value, no problems will occur. It is desirable that a tape for collecting the control images is transparent and it is sufficient that such a tape has a stickiness necessary to collect the toner. In the embodiment, the tape named "super stick" made by Lintec Co., Ltd. is used. After the control images passed through the cleaning process 1, the image forming apparatus is stopped at proper timing. The "super stick" comes into contact with the control images remaining on the secondary transfer roller. A pressure is applied onto the seal and the tape is peeled off. The tape on which the control images have been transferred is adhered onto white paper. The concentration measurement is performed in the state where the tape has been adhered onto the white paper. A spectro densitometer 500 series made by X-RITE Co., Ltd. is used for the concentration measurement. At this time, since it is difficult to transport the control images on the fur brush 71 to the transparent seal, the control image (b) obtained after the passage through the secondary transfer roller 56 is transferred onto the tape. A ratio of an amount of toner (concentration) (a−b) which is adsorbed by the fur brush 71 to an amount of toner (concentration) (a) on the secondary transfer roller 56 at this time is now assumed to be a cleaning efficiency α(%) in the cleaning process 1. The cleaning efficiency α is obtained by:

$$\alpha=((a-b)/a)\times 100(\%).$$

Similarly, a ratio of an amount of toner (c) which is adsorbed by the metal roller 72 to an amount of toner (a−b) on the fur brush 71 is now assumed to be a cleaning efficiency β(%) in the cleaning process 2. The toner of a control image (c) transferred onto the metal roller 72 is transported onto the tape. Thus, the cleaning efficiency 13 is obtained by:

$$\beta=(c/(a-b))\times 100(\%).$$

Figure 4:
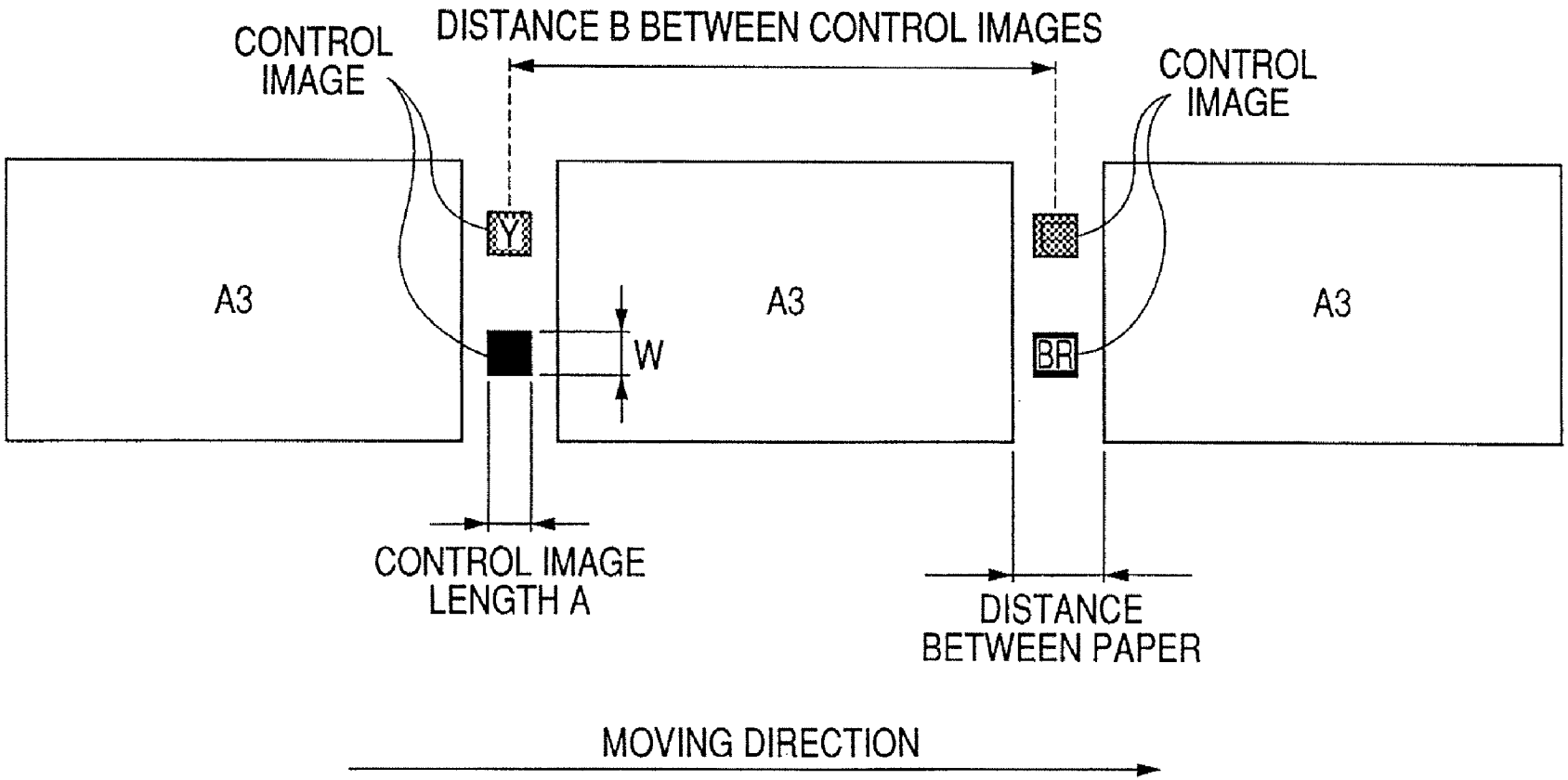
FIG. 4 is a schematic diagram for describing a forming method of control images.

In the embodiment, the control image (patch image) which is detected by the image concentration sensor 11 is formed on every interval between the paper from a viewpoint of stabilization of the image. FIG. 4 schematically illustrates the control images which are formed onto the intermediate transfer belt 51 with respect to the case of using the recording material S of the A3 size in the vertical feeding (the longitudinal direction of the recording material is set to the conveying direction and the recording material is fed along the conveying direction) as an example. In the embodiment, as illustrated in FIG. 4, a width of control image (length in the direction which perpendicularly crosses the surface moving direction of the intermediate transfer belt 51) (W) is set to 20 mm. A length of control image (length in the surface moving direction of the intermediate transfer belt 51) (A) is set to 10 mm. That is, the control image having a size of the width (W) of 20 mm and the length (A) of 10 mm is formed every time in an area between the transfer materials (interval between the paper) as an area (on the intermediate transfer belt 51) between the toner images which are transferred onto the transfer material S.

It is desirable that the length of control image lies within a range from 20 to 70 mm. If the length (A) of control image is less than 20 mm, sensitivity of the image concentration sensor 11 for reading the control images deteriorates and a reading error is liable to occur. If the length (A) of control image exceeds 70 mm, the length between the paper is necessary and there is a risk of deterioration of mass-productivity (the number of sheets which can be output per minute) of the image forming apparatus. In the embodiment, the toner concentration of the control image is equal to 0.7 mg/cm$^2$.

In the embodiment, the control image is formed in every area between the paper from the viewpoint of the image stabilization as mentioned above. In the embodiment, the image concentration sensors 11 are arranged at two positions in the direction which perpendicularly crosses the surface moving direction of the intermediate transfer belt 51. Therefore, in the example illustrated in the drawing, in the area between the paper, the control images are formed at two positions in the width direction of the intermediate transfer belt 51. In the embodiment, a distance between the paper (length between the paper in the surface moving direction of the intermediate transfer member) is set to be as narrow as possible. One control image is formed in the area between the paper in the surface moving direction of the intermediate transfer belt 51.

[Cleaning Efficiencies of Cleaning Process 1 and Cleaning Process 2]

Figure 5:
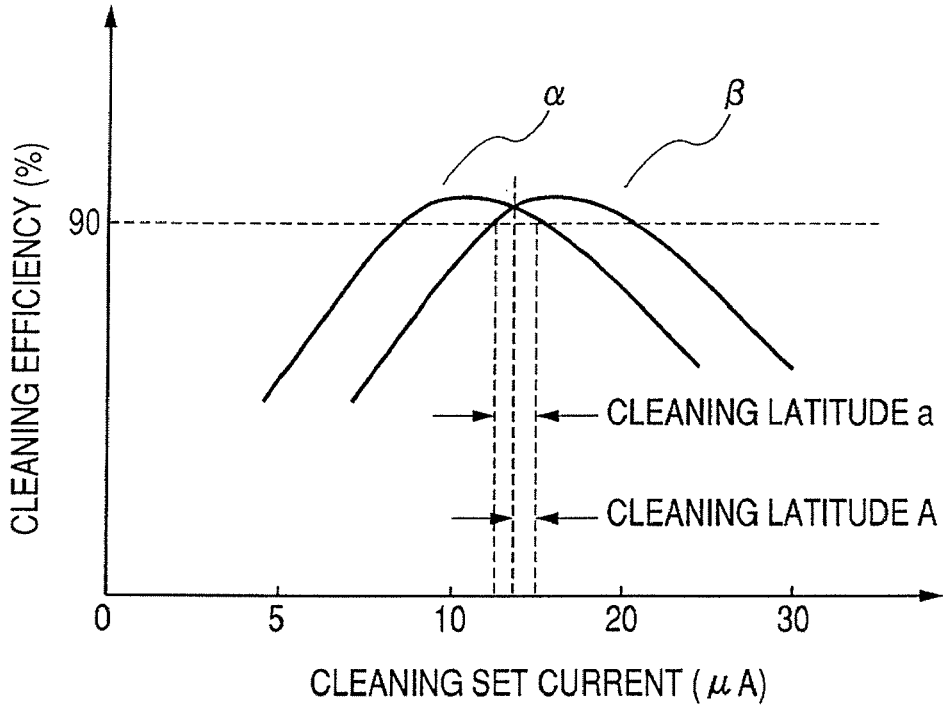
FIG. 5 is a graph showing a result obtained by measuring cleaning efficiencies $\alpha$ and $\beta$ while changing an output value of a cleaning bias.

FIG. 5 shows an experiment result obtained by measuring the cleaning efficiencies $\alpha$ and $\beta$ while changing the output value of the cleaning bias under the foregoing conditions in which the control images are formed. The cleaning bias at this time is applied by using a cleaning bias power source of a constant current control system for controlling by always setting a current to be constant. An axis of abscissa indicates the cleaning bias output current and an axis of ordinate indicates the cleaning efficiency. It will be understood from this graph that the larger the cleaning efficiency is, the better the cleaning performance is. A threshold value when the defective cleaning occurs in this instance is set to 90% or less as a cleaning efficiency. That is, when the cleaning efficiency of either the cleaning process 1 or the cleaning process 2 is equal to 90% or less, the defective cleaning occurs. At this time, the defective cleaning appears as a back fouling of the transfer material S.

Therefore, to prevent the defective cleaning from occurring, it is necessary to control the current value to a set current value at which the cleaning efficiency is larger than 90%. In this instance, a range where the cleaning efficiencies in both of the cleaning processes 1 and 2 are larger than 90% is defined as a cleaning latitude (a) (μA). In the case of FIG. 5, a value of the cleaning latitude (a) lies within a range shown by arrows.

As illustrated in FIG. 5, when the set current value is small, the cleaning efficiencies $\alpha$ and $\beta$ in both of the cleaning processes 1 and 2 are low. This is because the current (charge amount) adapted to transport the toner onto the fur brush 71 or the metal roller 72 is insufficient as compared with an amount of charges which the toner possesses.

On the contrary, when the set current value is large and the cleaning efficiencies are low, it is because since the current value (charge amount) is fairy larger than the amount of charges which the toner possesses, a possibility that the toner charges are inverted and the toner polarity is reversed is high, so that the cleaning efficiencies deteriorate.

Figure 6:
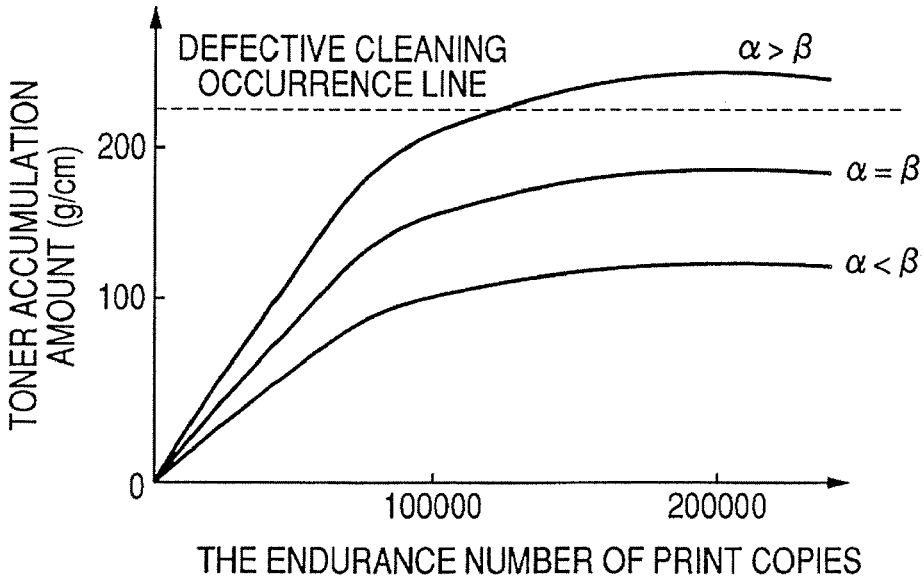
FIG. 6 is a graph showing a result obtained by measuring an accumulation amount of toner to a fur brush in the endurance number of print copies when values of $\alpha$ and $\beta$ are changed under such conditions that each of the cleaning efficiencies $\alpha$ and $\beta$ is larger than 90%.

FIG. 6 illustrates a result obtained by measuring an accumulation amount of the toner to the fur brush 71 at the endurance number of print copies when the values of $\alpha$ and $\beta$ are changed under the condition where each of the cleaning efficiencies $\alpha$ and $\beta$ is larger than 90%. The accumulation amount of the toner to the fur brush 71 is obtained by measuring a weight of the fur brush 71. The cleaning efficiencies $\alpha$ and $\beta$ are controlled by changing a penetration amount $\lambda_1$ of the fur brush 71 into the secondary transfer roller 56 and a penetration amount $\lambda_2$ of the fur brush 71 into the metal roller 72. When the penetration amount of the fur brush 71 is increased, the cleaning efficiencies increase. When the penetration amount is decreased, the cleaning efficiencies decrease. In the embodiment, it is assumed that $\lambda_1$=2.0 mm, $\lambda_2$=1.0 mm, and $\alpha>\beta$. It is also assumed that $\lambda_1=\lambda_2$=1.0 mm and $\alpha=\beta$. It is also assumed that $\lambda_1$=1.0 mm, $\lambda_2$=1.5 mm, and $\alpha<\Theta$.

In the above settings, under the condition of $\alpha\leqq\beta$, such a phenomenon that the toner remains in the fur brush 71 and the defective cleaning is caused does not occur. Under the condition of $\alpha\leqq\beta$, since an increase in toner, which is accumulated in the fur brush 71, can be reduced, the cleaning performance is improved. However, when $\alpha\leqq\beta$, there is a case where the toner remains in the fur brush 71 and the defective cleaning is caused. Therefore, such conditions that $\alpha\leqq90(\%)$, $\beta\leqq90(\%)$, and $\alpha\leqq\beta$ are necessary in order to satisfy both of the cleaning performance and the endurance life of the fur brush.

Therefore, by accomplishing the conditions that the cleaning efficiencies $\alpha$ and $\beta$ in both of the cleaning processes 1 and 2 are larger than 90% and by assuring a cleaning latitude A (refer to FIG. 5) as $\alpha\leqq\beta$ in an area as wide as possible, the good cleaning characteristics can be always maintained.

To obtain the cleaning latitude A, the cleaning characteristics are examined by changing the electric resistance value and the peripheral velocity of the fur brush 71, the peripheral velocity of the metal roller 72, and the surface roughness of the secondary transfer roller 56. An obtained experimental result is shown below.

[Electric Resistance of Fur Brush]

Figure 7:
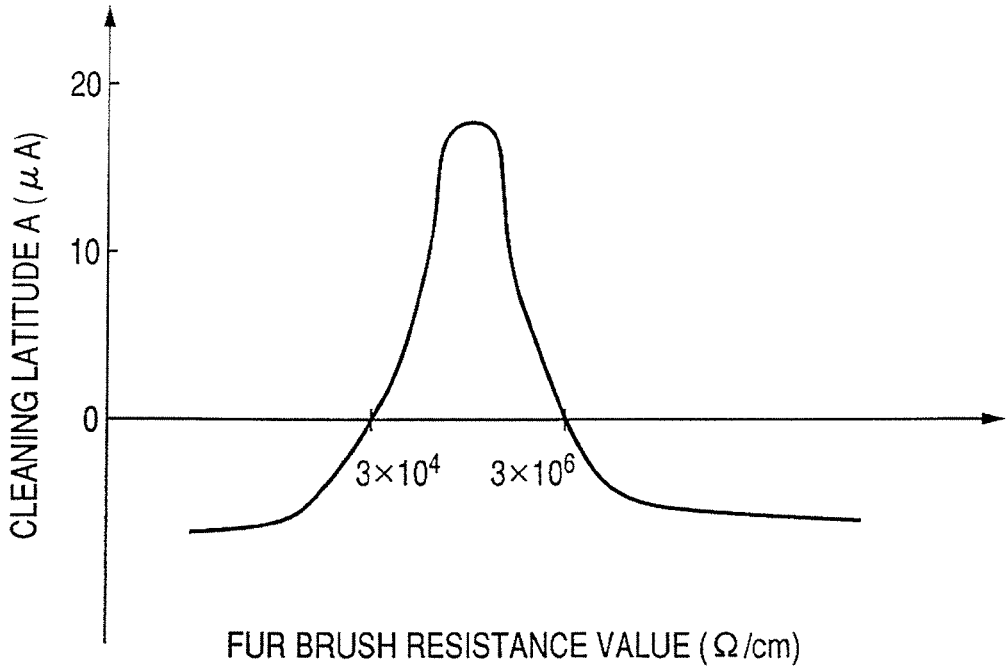
FIG. 7 is a graph showing a change in cleaning latitude A when an electric resistance value of the fur brush is changed.

In the image forming apparatus of the embodiment, a change in cleaning latitude A obtained by changing an electric resistance value r1 of the fur brush 71 is shown in FIG. 7. As shown in FIG. 7, when the electric resistance value r1 of the fur brush 71 lies within a range of $3\times10^4\leqq r1\leqq3\times10^6$ Ω/cm, the cleaning characteristics of the cleaning latitude A are obtained.

When the electric resistance value of the fur brush 71 is smaller than $3\times10^4$ Ω/cm, the cleaning latitude A does not exist but has a minus value. It is considered that a reason for such a state is that the potential difference caused between the fur brush 71 and the metal roller 72 is small.

If the potential difference caused between the fur brush 71 and the metal roller 72 is small, the resistance when the toner exists between them is relatively large and the current flows while avoiding the toner. Thus, the charges necessary for the cleaning cannot be applied to the toner. That is, it is because the cleaning efficiency of the cleaning process 2 deteriorates.

On the contrary, in the case where the electric resistance value of the fur brush 71 is larger than $3\times10^6$ Ω/cm, the cleaning latitude A does not exist either. It is because as follows. When the resistance value of the fur brush 71 is increased, the applied voltage rises. Therefore, a discharge phenomenon is liable to occur either between the secondary transfer roller 56 and the fur brush 71 or between the fur brush 71 and the metal roller 72. Since a larger amount of current flows into the toner by such a discharge phenomenon, the polarity of the charges of the toner is liable to be reversed and the cleaning efficiencies in the cleaning processes 1 and 2 deteriorate.

[Peripheral Velocity of Fur Brush]

Figure 8:
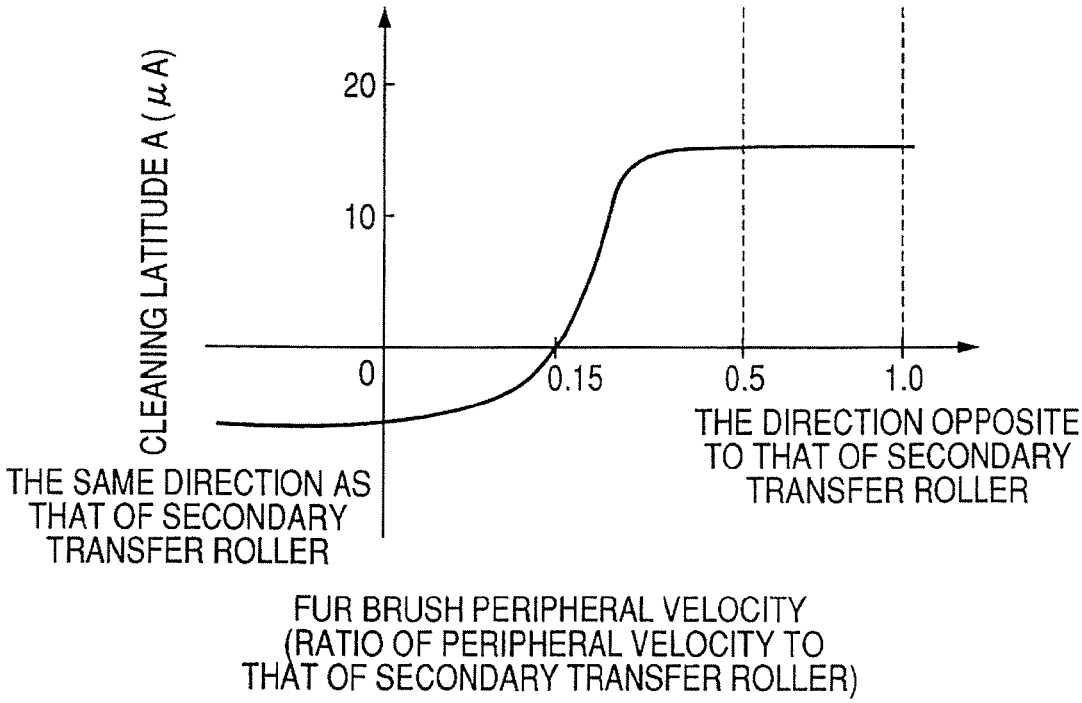
FIG. 8 is a graph showing a change in cleaning latitude A when a peripheral velocity of the fur brush is changed.

Subsequently, in the image forming apparatus of the embodiment, a change in cleaning latitude A obtained by changing the peripheral velocity (surface moving speed) V1 of the fur brush 71 is shown in FIG. 8. At this time, in the contact portion of the secondary transfer roller 56, the peripheral velocity of the metal roller 72 is equal to 1.0 (the same speed) in the same direction as the surface moving direction of the secondary transfer roller 56.

In the contact portion with the secondary transfer roller 56, the surface moving direction of the fur brush 71 is opposite to the surface moving direction of the secondary transfer roller 56 (refer to FIG. 3). As shown in FIG. 8, assuming that a peripheral velocity V0 of the secondary transfer roller 56 is equal to 1, when the peripheral velocity V1 of the fur brush 71 is equal to or larger than 0.15 (0.15 V0), the cleaning latitude A is obtained.

If the peripheral velocity V1 of the fur brush 71 is equal to or larger than 0.15 of a surface peripheral velocity V of the secondary transfer roller 56, there is a tendency that the cleaning latitude A increases. However, when the peripheral velocity V1 is equal to or larger than 0.5 (0.5 V0), there is a tendency that the cleaning latitude A is almost saturated. Further, when the peripheral velocity V1 is equal to or larger than 1.0 (1.0 V0), since the toner scattering occurs because the fur brush 71 rotates at a high speed, the back fouling of the transfer material S occurs.

Therefore, it will be understood that it is desirable to set the peripheral velocity V1 of the fur brush 71 to a value within a range from 0.15 time or more to 1.0 time or less than the peripheral velocity V0 of the secondary transfer roller 56. As an optimum range, it is desirable to set the peripheral velocity of the fur brush 71 to a value within a range from 0.5 time or more to 1.0 time or less than the peripheral velocity of the secondary transfer roller 56.

[Peripheral Velocity of Metal Roller]

Figure 9:
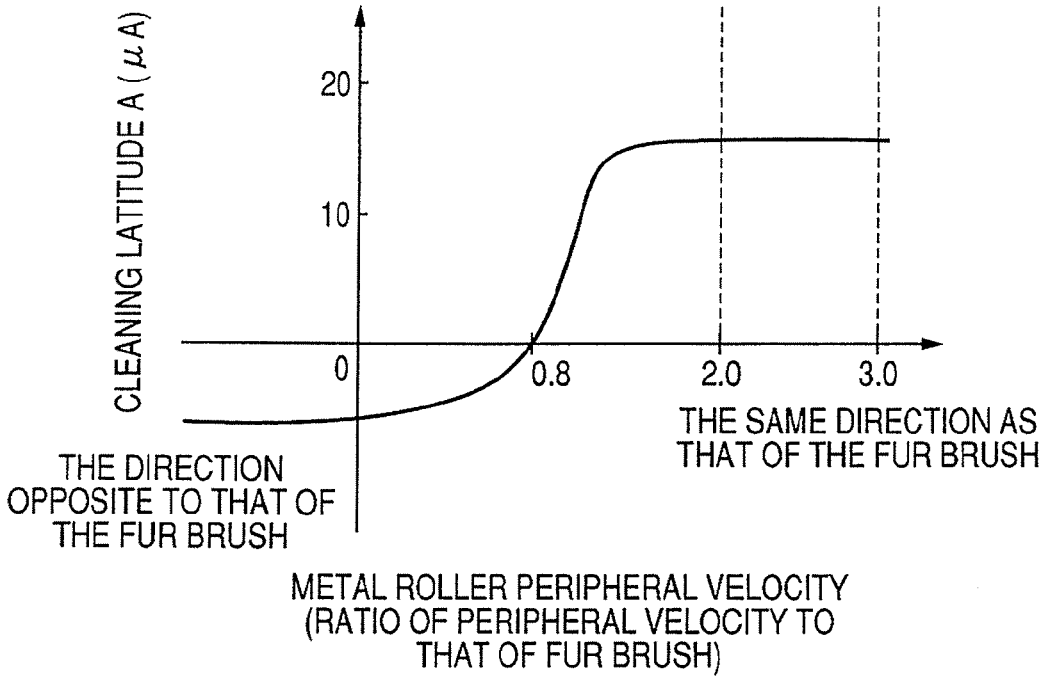
FIG. 9 is a graph showing a change in cleaning latitude A when a peripheral velocity of a metal roller is changed.

Subsequently, in the image forming apparatus of the embodiment, a change in cleaning latitude A obtained by changing a peripheral velocity (surface moving speed) V2 of the metal roller 72 is shown in FIG. 9.

At this time, in the contact portion with the fur brush 71, the surface moving direction of the metal roller 72 is the same as the surface moving direction of the fur brush 71 (refer to FIG. 3). As shown in FIG. 9, assuming that the peripheral velocity of the fur brush 71 is set to 1, when the peripheral velocity of the metal roller 72 is equal to or larger than 0.8, the cleaning latitude A is obtained.

If the peripheral velocity V2 of the metal roller 72 is equal to or larger than 0.8 (0.8 V1) of the peripheral velocity V1 of the fur brush 71, there is such a tendency that the cleaning latitude A increases. However, if it is equal to or larger than 2.0 (2.0 V1), there is such a tendency that the cleaning latitude A is almost saturated. Further, when the peripheral velocity V2 is equal to or larger than 3.0 (3.0 V1), since the toner scattering occurs because the metal roller 72 rotates at a high speed, the back fouling of the transfer material S occurs. Therefore, it will be understood that it is desirable to set the peripheral velocity V2 of the metal roller 72 to a value within a range from 0.8 times or more to 3.0 times or less than the peripheral velocity V1 of the fur brush 71. As an optimum range, it is desirable to set the peripheral velocity V2 of the metal roller 72 to a value within a range from 2.0 times or more to 3.0 times or less than the peripheral velocity V1 of the fur brush 71.

[Surface Roughness of Secondary Transfer Roller]

Figure 10:
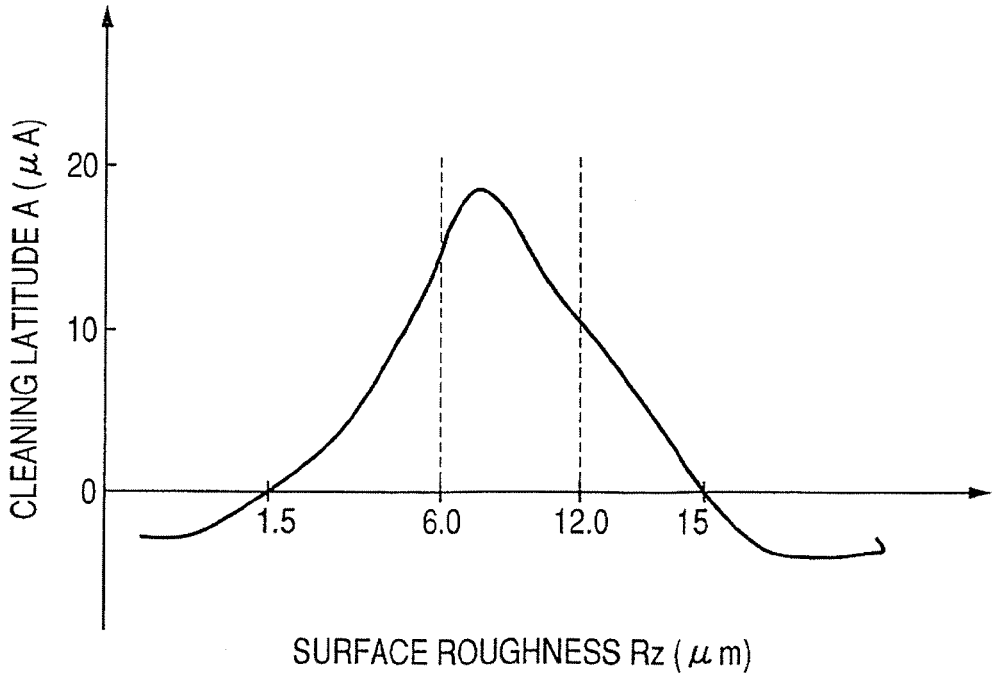
FIG. 10 is a graph showing a change in cleaning latitude A when a surface roughness of the secondary transfer roller is changed.

Subsequently, in the image forming apparatus of the embodiment, a change in cleaning latitude A obtained by changing a surface roughness of the secondary transfer roller 56 is shown in FIG. 10. The surface roughness of the secondary transfer roller 56 is measured by using a measuring instrument "Kosaka Laboratory Surfcorder SE3400". The surface roughness Rz is measured in the thrust direction of the secondary transfer roller 56 under conditions of a measuring speed of 0.1 mm/sec, a cut-off value of 0.8 mm, and a measurement length of 2.5 mm.

As shown in FIG. 10, to obtain the cleaning latitude A, it is necessary to set the surface roughness Rz of the secondary transfer roller 56 to a value within a range of 1.5 μm≦Rz≦15 μm. When Rz<1.5 μm, since the roller surface is smooth, an area of the contact with the transfer material S is large. Even if the cleaning efficiency is equal to or larger than 90%, the back fouling of the transfer material S occurs. Specifically speaking, it is necessary to set the cleaning efficiency to 95% or more. The cleaning latitude A, which satisfies such a condition, hardly exists.

Further, when Rz>15 μm, since the toner enters the concave portion of the secondary transfer roller 56, the fur brush 71 cannot be completely cleaned. Further, since the toner, which entered the concave portion and remains on the roller, is transferred again to the transfer material S by the discharge phenomenon upon secondary transfer, the back fouling of the transfer material S occurs.

By the above reasons, it is desirable to set the surface roughness Rz of the secondary transfer roller 56 to a value within the range of 1.5 μm≦Rz≦15 μm. Further, if the surface roughness lies within a range of 6 μm≦Rz≦12 μm, the cleaning latitude A is doubled, so that image characteristics in which the cleaning characteristics are more stabilized can be obtained.

Second Embodiment

Figure 11:
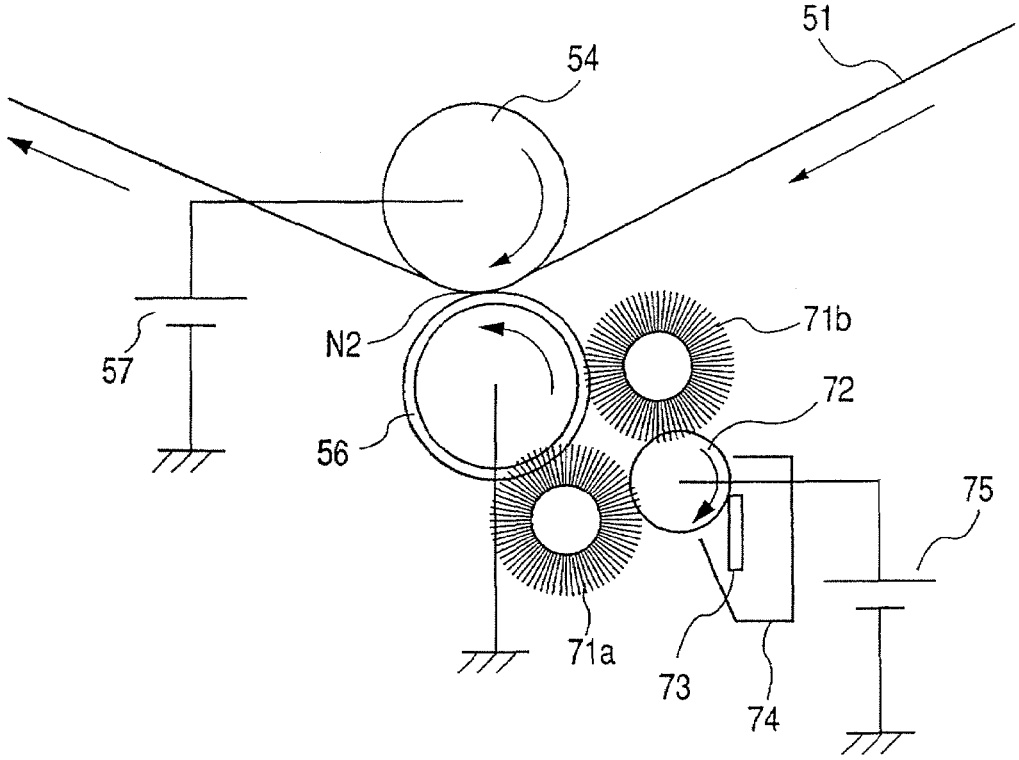
FIG. 11 is a schematic cross-sectional view of a secondary transfer apparatus in which two fur brushes according to the second embodiment are arranged.

An apparatus according to the second embodiment will now be described with reference to FIGS. 11 to 13. Since a fundamental construction of the apparatus of the embodiment is substantially the same as that in the foregoing first embodiment, its overlapped description is omitted and a characteristic construction of the second embodiment will be described. Component elements having the same functions as those in the foregoing embodiment are designated by the same reference numerals.

In the embodiment, a construction in which two fur brushes 71*a* and 71*b* are arranged in order to further widen the cleaning latitude A will be described with reference to FIG. 11. Electric resistance values of the two fur brushes 71*a* and 71*b* are equal to $3\times10^6$ Ω/cm. Peripheral velocities of the fur brushes 71*a* and 71*b* are also similarly set to 0.5 as a peripheral velocity ratio in the direction opposite to the surface moving direction of the secondary transfer roller 56 in contact portions with the secondary transfer roller 56. The cleaning efficiencies α and β in this instance are measured by the same method as that in the first embodiment.

Figure 12:
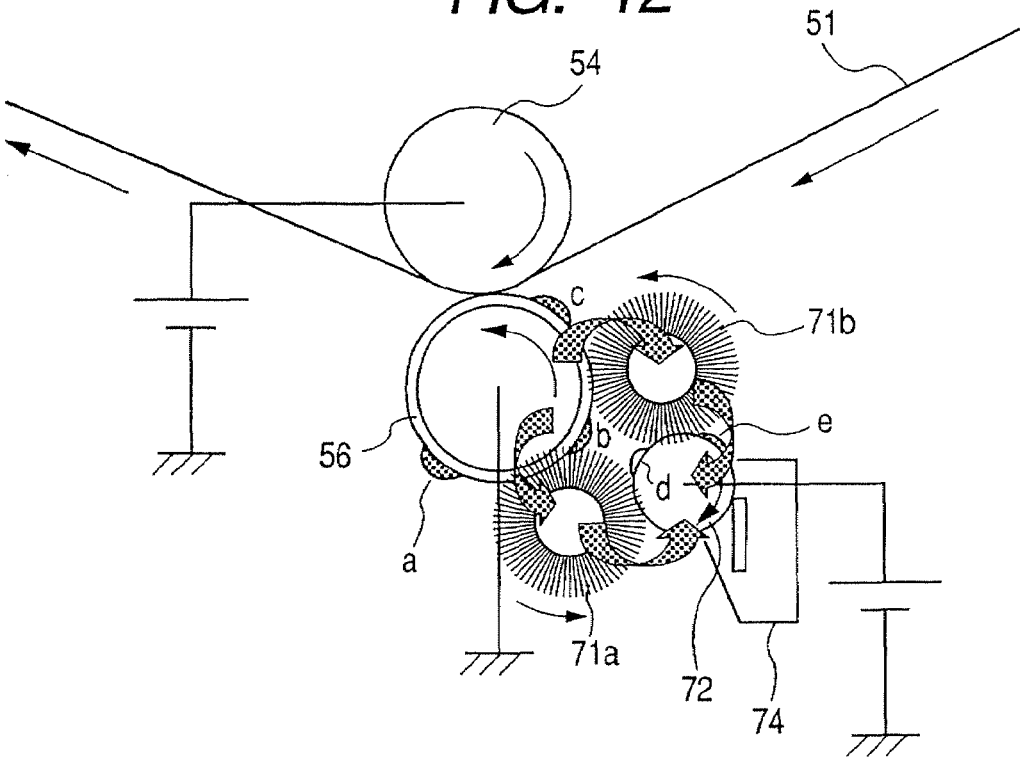
FIG. 12 is an explanatory diagram of a toner cleaning efficiency of a secondary transfer roller according to the second embodiment.

FIG. 12 is a schematic diagram for describing the cleaning efficiency. In FIG. 12, in the fur brush 71*a*, on the upstream side in the rotating direction of the secondary transfer roller 56, processes which are executed in a range from the secondary transfer roller 56 to the fur brush 71*a* are defined as a cleaning process 1. Processes which are executed in a range from the secondary transfer roller 56 to the fur brush 71*b* on the downstream side are defined as a cleaning process 1'. Processes which are executed in a range from the upstream side fur brush 71*a* to the metal roller 72 are defined as a cleaning process 2. Processes which are executed in a range from the downstream side fur brush 71*b* to the metal roller 72 are defined as a cleaning process 2'.

As illustrated in FIG. 12, it is assumed that an amount of toner on the secondary transfer roller 56 before the cleaning is equal to (a), an amount of toner on the secondary transfer roller 56 after the cleaning process 1 is equal to (b), an amount of toner on the secondary transfer roller 56 after the cleaning process 1' is equal to (c), an amount of toner on the metal roller 72 after the cleaning process 2 is equal to (d), and an amount of toner on the metal roller 72 after the cleaning process 2' is equal to (e), respectively.

Cleaning efficiencies α and α' in the cleaning processes 1 and 1' in this instance are as follows:

$$\alpha=((a-b)/a)\times100(\%);\text{ and}$$

$$\alpha'=((b-c)/b)\times100(\%).$$

Cleaning efficiencies β and β' in the cleaning processes 2 and 2' are as follows:

$$\beta=(d/(a-b))\times 100(\%);\text{ and}$$

$$\beta=(e/(b-c))\times 100(\%).$$

Figure 13:
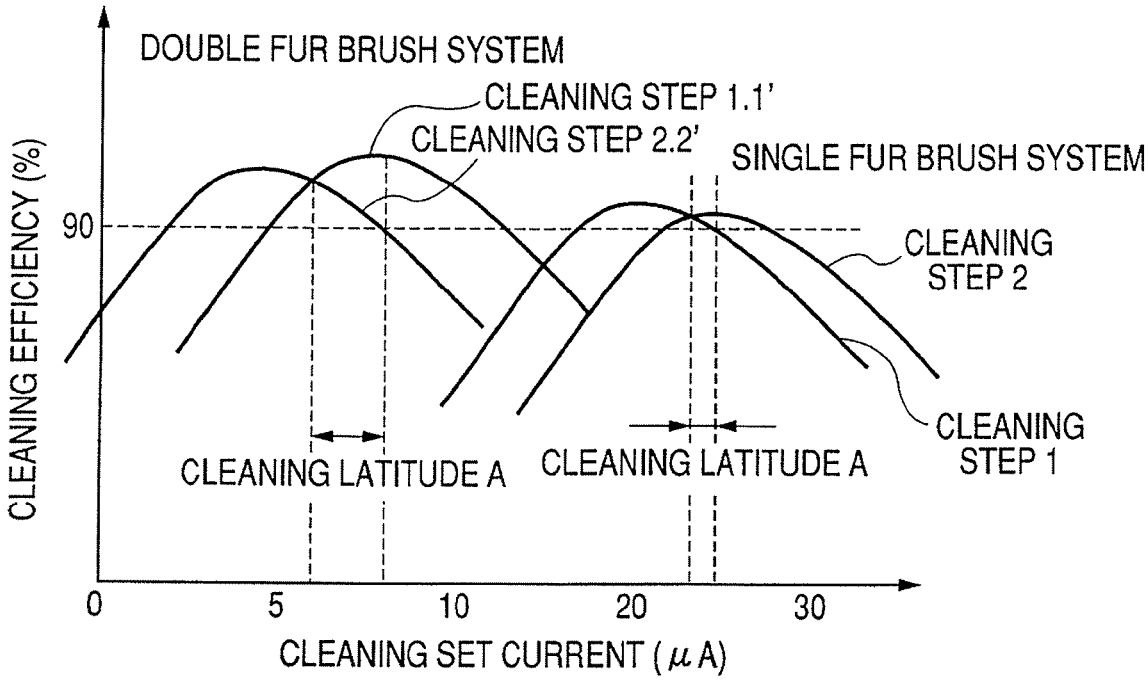
FIG. 13 is a graph for describing a cleaning efficiency according to the second embodiment.

The cleaning efficiency in the cleaning process 1 in this instance is shown in FIG. 13. It will be understood that since the number of fur brushes is increased from 1 to 2, peak values of the cleaning efficiencies in both of the cleaning processes 1 and 2 are shifted to the low current side.

It will be also understood that since the number of times at which the cleaning can be executed while the control images transferred onto the secondary transfer roller 56 are circulated once is doubled from 1 to 2, the peak values of the cleaning efficiencies are further increased.

Therefore, the cleaning latitude A is increased to a value near two times. Consequently, by using the construction of the embodiment, the image forming apparatus having the further stable cleaning characteristics can be provided.

According to the embodiment as mentioned above, the high concentration toner which is transferred onto the secondary transfer roller 56 is desirably removed and the back fouling of the transfer material S and the image defect upon duplex printing can be prevented. The excellent cleaning performance of the secondary transfer roller 56 by the fur brushes can always be accomplished in correspondence to the control images between the paper, which are formed during the image creation to the various transfer materials S. Thus, according to the embodiment, the cleaning performance of the secondary transfer member, which is obtained when the control images are repetitively formed at predetermined intervals into a plurality of areas between the transfer materials, can be improved.

In each of the embodiments 1 and 2 as mentioned above, the image forming apparatus in which the secondary transfer member cleaning apparatus 7 for collecting the toner is provided for the secondary transfer roller 56 for transferring the toner images on the intermediate transfer belt 51 onto the transfer material has been shown. However, it is also possible to construct in such a manner that the nip portion is formed in contact with the photosensitive drum 1 and the secondary transfer member cleaning apparatus 7 in each of the embodiments 1 and 2 can be also provided for the transfer member for transferring the toner images from the photosensitive drum 1 to the transfer material sandwiched in the nip portion.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2006-111045, filed Apr. 13, 2006, which is hereby incorporated by reference herein in its entirety.

What is claimed is:

1. An image forming apparatus comprising:

an image bearing member which bears a toner image;

a transfer member which is electrically connected to a ground and comes into pressure contact with the image bearing member, wherein the transfer member is rotatable and forms a transfer portion transferring the toner image on the image bearing member onto a recording material;

a first cleaning brush which comes in contact with the transfer member and electrostatically collects the toner on the transfer member;

a second cleaning brush which is arranged between a downstream side from the first cleaning brush and an upstream side from the transfer portion in a rotating direction of the transfer member, wherein the second cleaning brush comes in contact with the transfer member and electrostatically collects the toner on the transfer member;

a collecting member which comes in contact with the first and the second cleaning brushes and electrostatically collects the toner on the first and the second cleaning brushes; and a power source which applies a current to the collecting member, and the current is constant current controlled so that a current value is constant, wherein the current applied from the power source to the collecting member is controlled by adjusting the current value to a set current value in order to satisfy the following requirements:

when a ratio of an amount of toner which is collected by the first and the second cleaning brushes to an amount of toner on the transfer member is assumed to be α(%), and when a ratio of an amount of toner which is collected by the collecting member to an amount of toner on the first and the second cleaning brushes is assumed to be β(%), $$\alpha>90(\%),\ \beta>90(\%),\text{ and }\alpha\leqq\beta.$$

2. An image forming apparatus according to claim 1, wherein an electric resistance value r1 of the first and the second cleaning brushes is within a range of $3\times10^4\leqq r1\leqq 3\times10^6$ (Ω/cm).

3. An image forming apparatus according to claim 1, wherein in a contact portion with the transfer member, a surface moving direction of the first and the second cleaning brushes is opposite a surface moving direction of the transfer member.

4. An image forming apparatus according to claim 1, wherein in a contact portion with the first and the second cleaning brushes, a surface moving direction of the collecting member is the same as a surface moving direction of the first and the second cleaning brushes.

5. An image forming apparatus according to claim 1, wherein the transfer member is an elastic member having a coating layer on the surface and a surface roughness Rz of the surface layer is within a range of 1.5 μm≦Rz≦15 μm.

6. An image forming apparatus according to claim 1, wherein an electric resistance value r0 of the transfer member is within a range of $1.5\times10^5\leqq r0\leqq 1.5\times10^6$ (Ω/cm).

7. An image forming apparatus according to claim 1, wherein a rotating speed of the first cleaning brush is the same as a rotating speed of the second cleaning brush.

8. An image forming apparatus according to claim 1, further comprising a removing member which comes in contact with the collecting member and removes the toner on the collecting member.

* * * * *